US005288525A

United States Patent [19]

Diana

[11] Patent Number: 5,288,525

[45] Date of Patent: Feb. 22, 1994

[54] METHOD OF AND SYSTEM FOR DELIVERING CONDUCTIVE COATING MATERIAL TO ELECTROSTATIC SPRAYING APPARATUS

[75] Inventor: Michael J. Diana, West Dundee, Ill.

[73] Assignee: Binks Manufacturing Company, Franklin Park, Ill.

[21] Appl. No.: 856,658

[22] Filed: Mar. 24, 1992

[51] Int. Cl.[5] ..... B05D 1/04; B05D 1/06; B05B 7/16

[52] U.S. Cl. ..... 427/475; 118/302; 118/629; 118/697; 239/3; 239/112; 239/113; 239/305

[58] Field of Search ..... 118/629, 697, 302; 427/475; 239/3, 112, 113, 305

[56] References Cited

U.S. PATENT DOCUMENTS

| | | | |
|---|---|---|---|
| 3,933,285 | 1/1976 | Wiggins | 222/56 |
| 4,313,475 | 2/1982 | Wiggins | 141/18 |
| 4,509,684 | 4/1985 | Schowiak | 239/305 X |
| 4,771,729 | 9/1988 | Planert et al. | 118/697 |
| 4,792,092 | 12/1988 | Elberson et al. | 239/3 |
| 4,879,137 | 11/1989 | Behr et al. | 427/27 |
| 4,932,589 | 6/1990 | Diana | 239/3 |
| 4,962,724 | 10/1990 | Prus et al. | 118/688 |
| 5,106,024 | 4/1992 | Frene et al. | 239/112 X |

*Primary Examiner*—Bernard Pianalto
*Attorney, Agent, or Firm*—Juettner Pyle & Lloyd

[57] ABSTRACT

A system for coupling a grounded color changer to an electrostatic coating material sprayer electrically isolates the color changer from a high voltage at the sprayer. The system has a fluid path extending from the color changer to the sprayer and a reservoir is coupled to the fluid path at a connection point intermediate the color changer and sprayer. To fill the system with coating material to be sprayed, the fluid path to the sprayer is first filled with coating material from the color changer, following which the remaining coating material to be sprayed during the coating operation is flowed from the connection point into the reservoir. At least a portion of the fluid path between the connection point and the color changer is then cleaned of coating material to electrically isolate the reservoir and the sprayer from the color changer. Coating material is then delivered from the reservoir to the sprayer for being subjected to a high voltage and emitted in an electrostatically charged atomized spray. At the end of spraying, the high voltage is removed from the sprayer, and the reservoir, fluid path and sprayer are cleaned of coating material of the color just sprayed and reloaded with the next color of coating material to be sprayed.

26 Claims, 3 Drawing Sheets

FILL SYSTEM WITH PAINT
ISOLATE COLOR CHANGER AND RESERVOIR
SPRAY PAINT

| STEP | FA | FB | Z | C | E | K | D | BZ | DD | B | SS | TT | M | U | GG | O | COLOR#1 | RESULT |
|---|---|---|---|---|---|---|---|---|---|---|---|---|---|---|---|---|---|---|
| 0 | X | X | X | X | X | X | X | X | X | X | X | X | X | X | X | X | X | ALL VALVES CLOSED |
| 1 | X | O | X | X | X | X | O | X | X | X | X | X | O | X | X | X | O | LOAD PAINT TO SPRAY DEVICE |
| 2 | X | O | O | O | O | X | X | X | X | X | X | X | X | X | X | X | O | LOAD RESERVOIR |
| 3 | X | O | O | O | O | X | X | X | X | X | X | X | X | O | X | X | X | AIR BUBBLE PAINT PUSH |
| 4 | O | X | X | X | O | X | X | O/X | O/X | X | O/X | X | X | O/X | O/X | O/X | X | ISOLATE RESERVOIR AND SPRAY DEVICE |
| 5 | X | X | O | O | X | X | X | O | X | X | X | X | O | X | X | X | X | SPRAY PAINT |

O = VALVE OPEN
X = VALVE CLOSED
O/X = VALVE ALTERNATELY OPEN AND CLOSED

Fig. 2

Fig. 3A

FLUSH FLUID PATH FROM COLOR CHANGER AND SPRAY DEVICE

| VALVES | | | | | | | | |
|---|---|---|---|---|---|---|---|---|
| Q FB D M | U FB D M | FB GG | FB D M GG GUN | FB U D M | FB D M GG TT GUN | FB U D M TT | FB U D M GUN | READY TO LOAD COLOR TO GUN ONLY |
| STEP 1 | STEP 2 | STEP 3 | STEP 4 | STEP 5 | STEP 6 | STEP 7 | STEP 8 | STEP 9 |

Fig. 3B

FLUSH RESERVOIR

| VALVES | | | | | | | |
|---|---|---|---|---|---|---|---|
| DD C B K | B 2 C K | C Z E | DD B2 C K | DD B C K | DD C K | B2 C K | READY TO LOAD RESER-VOIR |
| STEP 1 | STEP 2 | STEP 3 | STEP 4 | STEP 5 | STEP 6 | STEP 7 | STEP 8 |

Fig. 3C

TIME

METHOD OF AND SYSTEM FOR DELIVERING CONDUCTIVE COATING MATERIAL TO ELECTROSTATIC SPRAYING APPARATUS

BACKGROUND OF THE INVENTION

The present invention relates to a method of and a system for coupling a grounded color changer and associated grounded supplies of conductive paint to electrostatic spraying equipment, while maintaining electrical isolation between a high voltage at the spraying equipment and the color changer and paint supplies.

Color changers for spray coating apparatus have application in industrial operations where articles are to be spray coated at a station or as they move along a production line. Where the articles are to be coated a wide variety of colors, it generally is not practical to establish separate spray stations or production lines for each color, or even to spray a long sequence of articles one color, then another long sequence a second color, etc. Instead, it is desirable to make color changes rapidly and simply at a single station.

Electrostatic spray coating devices have an increased painting efficiency over non-electrostatic types. When painting with an electrostatic spraying apparatus, it is necessary to have some means for applying a charge to the paint. In some apparatus, charging is accomplished by an electrode connected to a high voltage supply and placed in close proximity to or in contact with the paint either just prior or close to its point of atomization. In rotary atomization apparatus, the rotary atomizer is ordinarily made of a conductive material and connected to the power supply, and itself is the electrode. Whichever type of apparatus is used, the charging potential is usually on the order of several tens of kilovolts, and the electrostatic charging process works well when spraying nonconductive paints. However, when spraying conductive paints, such as waterborne or water based paints, precautions must be taken to prevent the high voltage at the spraying apparatus from shorting to ground through a conductive column of paint being delivered to the spraying apparatus.

One known approach to prevent shorting the high voltage to ground when spraying conductive paints is to isolate the entire paint supply and color change system from ground potential. This allows the paint supply and color change system to "float" at the charging potential, but has the drawback that a large amount of electrical energy is capacitively stored in the system. To prevent this energy from presenting a shock hazard to operating personnel, it is necessary to provide a protective enclosure around the color changer and paint supplies, which increases costs and requires that the spraying operation be shut down and the system electrically discharged whenever it is necessary to replenish the supplies of paint. Also, during operation of the system, the large amount of capacitively stored energy increases the potential for injury to an operator.

More recently, so-called isolation systems or voltage blocks have been employed to couple a grounded color changer and associated grounded supplies of conductive paint to an electrostatic sprayer in order to isolate the color changer and paint supplies from the high voltage at the sprayer. Such voltage block systems often have at least one reservoir into which a volume of one color of paint to be sprayed is introduced. After the reservoir is filled with paint, at least part of the fluid line between the reservoir and color changer is flushed clean to electrically isolate the paint in the reservoir from the color changer and paint supplies. The paint in the reservoir is then delivered to the sprayer for being emitted in an electrostatically charged atomized spray, with the cleaned portion of the fluid line between the reservoir and color changer then providing electrical isolation to prevent the high voltage at the sprayer from being coupled to the grounded color changer through a conductive paint path extending between the sprayer and the color changer. At the end of spraying the one color of paint, the high voltage is removed from the sprayer and the reservoir, fluid lines and sprayer are cleaned of paint of the one color and reloaded with paint of another color. Often such voltage block systems have two reservoirs which alternately receive and deliver selected colors of paint to the sprayer, so that one reservoir may be cleaned and reloaded with paint while the other reservoir delivers paint to the sprayer, thereby to shorten color change times. One such dual reservoir voltage block system is taught by U.S. Pat. No. 4,932,589, assigned to the assignee of the present invention. Other voltage block systems are taught by U.S. Pat. Nos. 4,771,729, 4,792,092 and 4,962,724.

Although rapid color changes can be made with voltage block systems that utilize two reservoirs, the art does not provide particularly fast color changes when only a single reservoir voltage block is used. This is because of the number and the nature of the steps that are performed with known single reservoir voltage block systems in order to clean the systems to make a color change.

OBJECTS OF THE INVENTION

An object of the present invention is to provide a single reservoir isolation or voltage block system for connection between a grounded color changer and a high voltage electrostatic spray coating apparatus to electrically isolate the color changer from the high voltage at the coating apparatus.

Another object is to provide such an isolation system, the method of operation of which is such as to shorten the time required to make a color change.

A further object is to provide such an isolation system, in which only a limited metered quantity of paint is charged to the high voltage during a spraying operation.

Yet another object is to provide such an isolation system, in which the conductive fluid in the system is grounded whenever the high voltage is removed from the spray apparatus.

SUMMARY OF THE INVENTION

In accordance with the present invention, there is provided a system for delivering electrically conductive coating material from a coating material supply to high voltage electrostatic coating apparatus. The system comprises a fluid path for coupling the coating material supply to the coating apparatus; a reservoir coupled to the fluid path at a connection point intermediate the coating material supply and the coating apparatus; and means for flowing coating material from the coating material supply first into and through the fluid path and past the connection point to the coating apparatus to fill the fluid path with coating material, and then from the connection point into the reservoir. Also included is means, operative after operation of the flowing means, for cleaning coating material from at least a portion of the fluid path between the coating material supply and the connection point to electrically isolate the coating material supply from both the coating apparatus and the reservoir; and means, operative after operation of the cleaning means, for delivering the coating material in the reservoir through the fluid path from the connection point to the coating apparatus for being electrostatically charged and emitted by the coating apparatus.

The invention also contemplates that the coating material supply be a color changer. In this case, the fluid path couples an outlet from the color changer to the coating apparatus and the reservoir is coupled to the fluid path at the connection point intermediate the color changer outlet and the coating apparatus. The flowing means flows a selected color of coating material from the color changer outlet first into and through the fluid path and past the connection point to the coating apparatus to fill the fluid path, and then from the connection point into the reservoir. After operation of the flowing means, the cleaning means cleans coating material from at least a portion of the fluid path between the color changer outlet and the connection point to electrically isolate the color changer from the coating apparatus and the reservoir, whereafter the delivering means delivers the selected color of coating material in the reservoir through the fluid path from the connection point to the coating apparatus for being electrostatically charged and emitted by the coating apparatus. The system also has means, operative after operation of the delivery means, for cleaning the selected color of coating material from the reservoir, the fluid path and the coating apparatus prior to the flowing means flowing the next selected color of coating material from the color changer outlet.

When the system includes a color changer, the means for cleaning the reservoir, the fluid path and the coating apparatus includes first means for cleaning the reservoir for a first period of time and second means for simultaneously cleaning the fluid path and the coating apparatus for a second and shorter period of time, such that cleaning of the fluid path is completed prior to completion of cleaning of the reservoir. The flowing means then flows each successive selected color of coating material into and through the fluid path and past the connection point to the coating apparatus after completion of operation of the second cleaning means and while the first cleaning means continues to clean the reservoir of the previously selected color of coating material. Then, after completion of operation of the first cleaning means, the next selected color of coating material is flowed from the connection point into the reservoir.

The invention also provides a method of supplying electrically conductive coating material from a coating material supply to high voltage electrostatic coating apparatus, while maintaining electrical isolation between the high voltage at the coating apparatus and the coating material supply. The method comprises the steps of coupling the coating material supply to the coating apparatus through a fluid path; coupling a reservoir to the fluid path at a connection point intermediate the coating material supply and the coating apparatus; and flowing coating material from the coating material supply first into and through the fluid path and past the connection point to the coating apparatus to fill the fluid path, and then from the connection point into the reservoir. After completion of the flowing step, coating material is cleaned from at least a portion of the fluid path between the coating material supply and the connection point to electrically isolate the coating material supply from the coating apparatus and the reservoir. After performance of the cleaning step, coating material in the reservoir is delivered through the fluid path from the connection point to the coating apparatus for being electrically charged and emitted by the coating apparatus.

The method of the invention also provides for supplying selected colors of electrically conductive coating material from a color changer to the high voltage electrostatic coating apparatus. In this case, the coupling step couples an outlet from the color changer to the coating apparatus through the fluid path; the connection point where the reservoir is coupled to the fluid path is intermediate the color changer and the coating apparatus; and the flowing step flows a selected color of coating material from the color changer outlet first into and through the fluid path and past the connection point to the coating apparatus to fill the fluid path, and then from the connection point into the reservoir. After completion of the flowing step, the cleaning step cleans coating material from at least a portion of the fluid path between the color changer outlet and the connection point to electrically isolate the color changer from the coating apparatus and the reservoir and, after completion of the cleaning step, the delivering step delivers the selected color of coating material in the reservoir through the fluid path from the connection point to the coating apparatus for being electrostatically charged and emitted by the coating apparatus. In addition, in order to prepare for receiving the next selected color of coating material from the color changer, also includes is the step, after performance of the delivering step, of cleaning the reservoir, the fluid path and the coating apparatus of the previously selected color of coating material.

When practicing the method with a color changer, the step of cleaning the reservoir, the fluid path and the coating apparatus advantageously includes the steps of cleaning the reservoir for a first period of time, and simultaneously cleaning the fluid path and the coating apparatus for a second and shorter period of time, such that cleaning of the fluid path is completed prior to cleaning of the reservoir. The flowing step then flows each successive selected color of coating material into and through the fluid path and past the connection point to the coating apparatus after completion of the step of cleaning the fluid path of the previously selected color of coating material and while the reservoir is still being cleaned of the previously selected color of coating material. Then, upon completion of cleaning the reservoir, the next selected color of coating material is flowed from the connection point into the reservoir.

The foregoing and other objects, advantages and features of the invention will become apparent upon a consideration of the following detailed description, when taken in conjunction with the accompanying drawing.

BRIEF DESCRIPTION OF THE DRAWINGS

FIG. 2 is a truth table showing a contemplated operation of the system in delivering a selected color of paint to the spraying apparatus, and FIGS. 3A, 3B and 3C show a contemplated operation of the system in cleaning the system between color changes and a contemplated time relationship between the steps.

DETAILED DESCRIPTION

Figure 1:
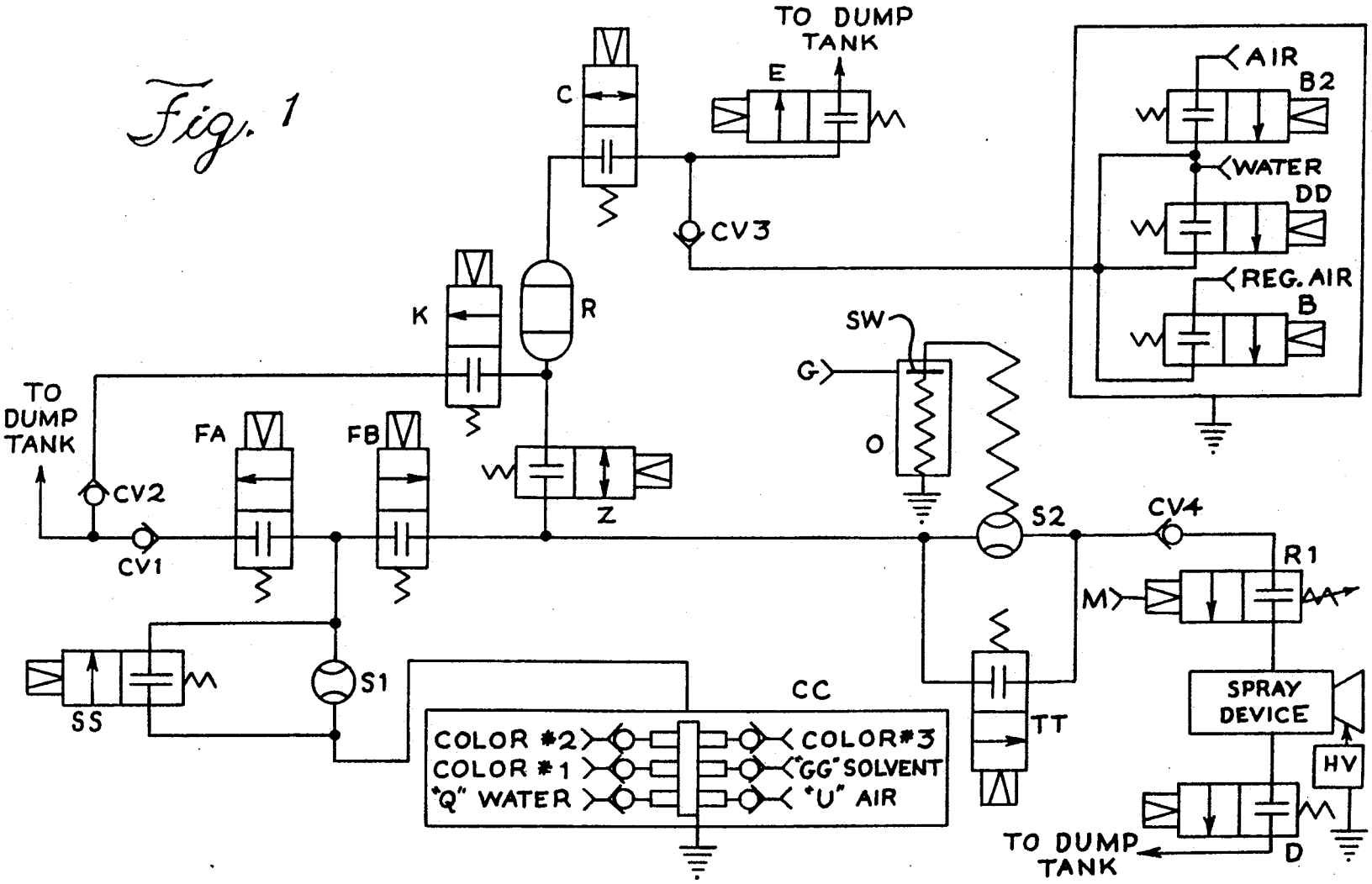
FIG. 1 schematically represents an isolation system embodying the teachings of the invention, for being connected between a color changer assembly and an electrostatic spray apparatus and for delivering metered quantities of electrically conductive paint from the color changer to the spray apparatus while electrically isolating the color changer and its associated paint supplies from a high electrostatic charging voltage at the spray apparatus.

FIG. 1 shows a high voltage electrostatic spray apparatus that includes a spray device or spray gun adapted to be supplied with and to spray any one of a plurality of different colors of coating material or paints. Also shown is a grounded color changer assembly that is operable to selectively supply any one of a number of different colors of paint to the spray device. The color changer assembly is not connected directly to the spray device, but instead is connected to the spray device through an isolation system or voltage block that is constructed and operated according to the teachings of the invention. Paint provided by the color changer assembly may be electrically nonconductive, but the isolation system uniquely adapts it to supply conductive paint to the spray device by maintaining electrical isolation of the color changer and its paint supplies from the high voltage at the spray device.

The isolation system has been developed primarily for supplying selected colors of water based paints to high voltage electrostatic spray coating apparatus. Previously, when spraying water based paints electrostatically, any paint supply pumps, pressure pots, color changers, paint supplies, etc., had to be isolated from ground by means of isolation stands. The isolation system of the invention, however, advantageously enables all such components to remain at ground potential. This greatly reduces the hazard of a high capacitance electrical discharge and provides an effective, safe and economical manner in which to apply water based paints electrostatically.

The isolation system has a single reservoir R that is periodically supplied by the color changer assembly with selected colors of paint to be delivered to the spray device as required for specific jobs. The color changer assembly and its paint supplies are grounded, and once the reservoir is filled with paint, it is electrically isolated from the color changer assembly and paint supplies by cleaning paint from a fluid line extending between it and the color changer assembly. For safety purposes, a pneumatically operated ground leg O, having a normally closed switch SW that is controlled by a pneumatic signal at a control inlet G, grounds the conductive fluid contents of the isolation system during fill and cleaning cycles. While paint is being delivered from the reservoir to the spray device, the switch SW is opened and the ground leg removes ground from the conductive fluid contents, so that the high electrostatic charging voltage at the spray device is not shorted out to ground. For safety, the only time the contents of the system are not grounded by the ground leg is when the reservoir is delivering paint to the spray device and a high electrostatic charging voltage is present at the spray device. Should there be a power supply overload, the contents of the reservoir, fluid hose and spray device are grounded to eliminate the possibility of a high capacitance discharge.

The isolation system is positioned between the color changer assembly and the electrostatic spray apparatus. The color changer assembly is conventional and includes a color changer CC which has a plurality of inlets connected to a corresponding plurality of grounded supplies of different colors of conductive paints or coating materials, which may be waterborne paints and of which colors 1, 2 and 3 represent three of what may be a large number of different colors. The color changer operates in a known manner to selectively supply at its outlet any one of the colors of paint, and has a valved water inlet Q connected to a source of water, which is a solvent for water based paints, a valved air inlet U and a valved chemical solvent inlet GG. An outlet from the color changer connects through a flow meter S1 to a pair of color changer directional valves FA and FB. A bypass valve SS is operable to selectively direct the outflow from the color changer either through the flow meter or to establish a bypass path around the flow meter. The color changer assembly is operable to supply selected colors of paint through the isolation system to the electrostatic spray apparatus, which includes the spray device, a pneumatically controlled fluid regulator R1 for controlling the pressure of paint at an inlet to the spray device in accordance with the value of a pneumatic signal at a control inlet M to the regulator, and a pneumatically controlled gun dump valve D in an outlet from the gun.

Considering the structure of the isolation system in greater detail, it includes a plurality of pneumatically controlled valves and fluid lines of electrically insulating material. The outlet from the color changer CC connects through the flow meter S1 and its bypass valve SS to inlets to the color changer directional valves FA and FB. An outlet from the valve FA connects through a check valve CV1 to a grounded dump tank, and an outlet from the directional valve FB connects through a flow meter S2, a check valve CV4 and the regulator R1 to the spray device. A bypass valve TT is actuable to establish a flow path around the flow meter.

The outlet from the directional valve FB also connects through a reservoir bottom paint valve Z to a lower inlet/outlet of the reservoir R. Also connected to the lower inlet/outlet of the reservoir are a reservoir bottom purge valve K and a check valve CV2 leading to the dump tank. Grounded supplies of high pressure air, water and regulated air at a pressure lower than the high pressure air are selectively connectable to an inlet to a check valve CV3 by means of respective valves B2, DD and B. The outlet from the check valve CV3 connects through a reservoir top vent/purge valve C to an upper inlet/outlet of the reservoir and through a reservoir top purge valve E to the dump tank.

The valves and fluid lines of the isolation system are made of electrically insulating material. The ground leg O connects to the flow meter S2 and is selectively deactuable and actuable by means of a pneumatic signal at the control inlet G to close and open the switch SW to ground and unground the conductive fluids in the fluid line through the flow meter and thereby the conductive fluid contents of the isolation system. The valves may be operated either manually or by automatic control.

FIG. 2 shows the steps involved in operation of the isolation system in delivering conductive paint from the color changer CC to the spray device and in isolating the grounded color changer and its associated grounded paint, air, solvent and water supplies from the high voltage at the spray device during a spraying operation.

Starting at a step O with all of the valves closed and with an empty and clean system, as an initial step a first selected color of paint, for example color 1, is loaded into the fluid path extending between the color changer outlet and the spray device. This is accomplished in a step 1 by flowing paint of color 1 from the color changer, while simultaneously actuating or opening the valves FB and D and applying to the regulator R1 a control inlet signal M that causes the regulator to freely pass a flow of paint through it. The volumetric capacity of the paint flow path between the color changer and spray device is known, and the flow meter S1 measures the volume flow of paint from the color changer. When the measured volume flow equals the volumetric capacity of the flow path in a step 2 the valve D is closed and the valves Z, C and E are opened, so that paint from the color changer then flows through the valve Z into the reservoir R. The total volume flow of paint from the color changer, as measured by the flow meter S1, is limited to only as much paint as is required for a spraying operation. When the flow meter measures the volume flow required for the spraying operation, the color changer valve for color 1 is closed.

At this point, a column of paint of known volume extends between the color changer and the connection point of the reservoir, via the valve Z, with the fluid path between the color changer outlet and the spray device. The column of paint comprises a portion of the total volume of paint to be sprayed, so in a step 3 the color changer valve U is opened for a predetermined time to introduce into the color changer an air bubble of a volume that pushes the remaining paint out of the color changer and through the flow meter S1 and the fluid path to the connection point and thereby pushes an equivalent volume of paint into the reservoir.

Next, the reservoir R and the spray device are electrically isolated from the grounded color changer assembly and from the grounded dump tank. This is accomplished by cleaning and drying the fluid paths between the reservoir and the spray device and each of the color changer assembly and the dump tank. To isolate the reservoir and spray device from the color changer assembly in a step 4 the valve FA is opened, the valves FB and Z are is closed and the color changer valves U and GG are alternately opened and closed to alternately flow air and solvent from the color changer CC to and through the valve EA and the check valve CV1 to the dump tank, to clean the fluid path between the color changer and the valve FA and thereby at least a portion of the fluid path between the color changer and each of the reservoir and the spray device to electrically isolate the reservoir and the spray device from the color changer assembly. During cleaning of the fluid path from the color changer to the valve FA, when air flows from the color changer, the bypass valve SS around the flow meter S1 is opened to prevent overdriving the flow meter. To finish cleaning the fluid path from the color changer to the valve FA, the valve U is opened to flow air through the fluid path for a time sufficient to dry the path.

Simultaneously with cleaning the fluid path between the color changer assembly and the valve FA, at least a portion of the fluid path between the top of the reservoir R and the dump tank is cleaned and dried to electrically isolate the reservoir and the spray device from the grounded dump tank. This also is accomplished in step 4 by closing the valve C and opening the valve E while alternately opening and closing the valves DD and B2 to alternately flow water and high pressure air through a portion of the fluid path that includes the valve E. To finish in isolating the reservoir and the spray device from the dump tank, the valve B2 is opened to flow high pressure air through the path for a time sufficient to dry the path.

Upon completion of electrical isolation of the reservoir and the spray device from the dump tank and the color changer assembly, the system is prepared to spray paint. This is accomplished in a step 5 by closing the valves E and FA and opening the valves B2, C and Z to pressurize the top of the reservoir and flow paint from the reservoir and through the flow meter S2 and the pressure regulator R1 to the spray device. At the same time, the ground leg O is actuated to open the switch SW to disconnect ground from the flow meter S2, a high electrostatic charging voltage is applied to the spray device and the signal at the pressure regulator control input M is adjusted to establish a selected flow rate of paint to the spray device. While spraying, the flow meter S2 monitors the flow rate of paint to the spray device and controls the signal at the control input M to the pressure regulator to maintain the selected flow rate. The flow meter also measures the total volume of paint delivered to the spray device, and since the total volume of paint loaded into the system is known, the flow meter can provide an indication when substantially the known volume of paint has been delivered to the spray device, in order to terminate the spraying operation. The substantial entirety of the paint loaded into the system can therefore be used in the spraying operation, which minimizes paint wastage and facilitates cleaning of the system incident to color changes. Also, by ensuring termination of spraying before the entirety of the paint loaded into the system has been delivered to the spray device, the accidental introduction of air into the spray device and spattering of paint onto articles being coated is prevented.

As mentioned, when a high electrostatic charging voltage is applied to the spray device in a spraying operation, the ground leg O is energized by a pneumatic signal at the control inlet G to open the switch SW to remove ground potential from the conductive fluid contents of the isolation system, so that the high voltage at the spray device is not shorted out. Should there be a high voltage overload, the ground leg is deenergized to ground the system and eliminate the possibility of a high capacitance discharge at the spray device.

If a different color of paint is to be sprayed next, the system must first be cleaned of paint of color 1 before the new color of paint is loaded into it. Cleaning the system comprises flushing the fluid paths, the reservoir and the spray device. To shorten the time required to clean the system, the various components are cleaned simultaneously.

FIGS. 3A, 3B and 3C show the steps involved in cleaning the system, which steps begin with all of the valves closed. It being understood that any valve not specifically identified in FIGS. 3A–3B as being open is closed, to flush the fluid path from the color changer assembly to the spray device and the spray device itself, as shown in FIG. 3A, in a step 1 the valves FB, Q and D are opened and a signal is applied at the control input M to the pressure regulator R1 to cause the regulator to freely pass a flow of fluid. With the color changer water valve Q opened, water flows from the color changer through the fluid path and the flow meter S2 to and through the spray device, following which, in a step 2, the water valve Q is closed and the color changer air valve U is briefly opened to flow air through the path. At this point in the cleaning of the fluid path to the spray device and the spray device, and as will be further described below in connection with flushing of the reservoir, in a step 3 solvent is introduced into the bottom of the reservoir R by opening the valves FB, GG, Z, C and E to flow solvent from the color changer into the bottom of the reservoir. In a step 4, valves FB, D and GG are opened, a signal is applied at the control input M to the pressure regulator R1 to cause the pressure regulation to freely pass a flow of fluid and the spray gun is triggered on to flow solvent through the fluid path to and through the spray device. Next, in a step 5 the color changer air valve U is briefly opened to flow air through the fluid path to and through the spray device. In a step 6 color changer solvent valve GG is again opened to flow solvent through the fluid path to and through the spray device while the spray device is triggered on, during which time the bypass valve TT of the flow meter S2 is briefly opened for a flow of solvent through it. Next, in a step 7 the color changer air valve U is opened to flow air through the fluid path to and through the spray device to dry the path, during which time the bypass valve TT is briefly opened to dry the valve and, in a step 8, the spray device is briefly triggered on to remove residual solvent from its interior. As indicated in step 9, the spray device is then ready to receive the next color of paint.

As shown in FIG. 3B, cleaning of the reservoir R occurs simultaneously with cleaning of the fluid path to the spray device and of the spray device. In a step 1, with the valves C, B and K open, the valve DD is briefly opened to flow water into the top of and through the reservoir and through the valve K to the dump tank, following which, in a step 2, the valve B2 is briefly opened to flow high pressure air through the reservoir and to the dump tank. At this point, and as above described in connection with cleaning the fluid path to the spray device and the spray device, in a step 3 the valves Z, C and E are opened (while the color change valve GG is opened) to accommodate the flow of solvent into the bottom of the reservoir. In a step 4, the valves DD, B2, C and K are then opened to flow water and high pressure air through the reservoir and the valve K to the dump tank, after which, in a step 5, the valves DD, C, B and K are opened to flow water and air at a lower pressure through the reservoir to the dump tank. In a step 6, the valve DD is opened to flow water only through the reservoir, after which, in a step 7, the valve B2 is opened to flow high pressure air through the reservoir for a time sufficient to dry the reservoir and the fluid path through the valve K to the dump tank. The reservoir is then ready to be loaded with the next color of paint to be sprayed, as indicated by a step 8.

FIG. 3C shows a contemplated relationship between the time of occurrence of the steps involved in flushing the fluid path from the color changer to the spray device and the spray device, and the time of occurrence of the steps involved in flushing the reservoir.

Although the fluid path to the spray device and the spray device are cleaned simultaneously with the reservoir, less time is required to clean the fluid path to the spray device and the spray device than is required to clean the reservoir. Both cleaning operations begin at the same time. Consequently, after the fluid path to the spray device and the spray device have been cleaned, and while the reservoir is still being cleaned, the fluid path to the spray device may be filled with the next color of paint to be sprayed. Advantageously, the spray device is briefly triggered on when the next color of paint to be sprayed reaches it, in order to thoroughly clean its fluid nozzle of the last color of paint sprayed. Flowing the next color of paint to be sprayed into the fluid path to the spray device, while the reservoir is still being cleaned, shortens the time required to effect a color change. After the reservoir is cleaned, the remaining quantity of the next color of paint to be sprayed is flowed into it, whereupon the cycle of operation continues as above described.

To briefly summarize operation of the isolation system when a color change is to be made, a metered quantity of one color of paint, as measured by the flow meter S1, is flowed from the color changer CC first to the spray device to fill the fluid path between the color changer and the spray device, following which the remainder of the paint is flowed into the reservoir R. The reservoir and the spray device are then electrically isolated from the grounded color changer assembly and from the grounded dump tank by cleaning and drying at least portions of the fluid paths connecting the reservoir and the spray device to each of the color changer and the dump tank. Paint is then delivered from the reservoir to the spray device for being emitted in an electrostatically charged atomized spray. During spraying, the flow meter S2 monitors the flow rate of paint to the spray device and controls the value of the control signal applied to the pressure regulator R1 to maintain a selected flow rate. The flow meter S2 also monitors the total volume flow of paint to the spray device, so that spraying can be terminated when the substantial entirety of the paint loaded into the isolation system has been sprayed. Upon termination of spraying of the one color of paint, the color changer, reservoir, spray device and fluid paths are cleaned of paint of the one color in preparation for loading the next color of paint into the system. Since cleaning the reservoir requires more time than cleaning the fluid path from the color changer to the spray device and the spray device, upon completion of cleaning the fluid path to the spray device, and while the reservoir is still being cleaned, the next color of paint to be sprayed is flowed from the color changer into and through the fluid path to the spray device to fill the fluid path. Upon completion of cleaning of the reservoir, the remaining quantity of the next color of paint to be sprayed is then flowed into the reservoir, whereupon the reservoir and spray device are electrically isolated from the color changer assembly and dump tank, following which spraying occurs. For safety, the ground leg O connects the conductive fluid contents of the system to ground potential whenever a high electrostatic charging voltage is not present at the spray device.

If there is a repeat color situation, i.e., if the same color of paint is to be sprayed in two or more successive spraying operations, then it is not necessary to fully clean the system between spraying operations. In this case, when the reservoir R is nearly empty at the end of one spraying operation, as determined by the flow meter S2, instead of cleaning the system of paint, the reservoir is immediately refilled with the same color of paint for the next spraying operation. Following refilling of the reservoir, the reservoir and spray device are isolated from ground by cleaning and drying at least portions of the fluid paths connecting the reservoir and spray device to each of the color changer assembly and the dump tank, after which spraying again commences.

While one embodiment of the invention has been described in detail, various modifications and other embodiments thereof may be devised by one skilled in the art without departing from the spirit and scope of the invention, as defined in the appended claims.

What is claimed is:

1. A system for delivering electrically conductive coating material from a coating material supply to high voltage electrostatic coating apparatus, said system comprising a fluid path for coupling the coating material supply to the coating apparatus; a reservoir coupled to said fluid path at a connection point intermediate the coating material supply and the coating apparatus; means for flowing coating material from the coating material supply first into and through said fluid path past said connection point to the coating apparatus to fill said fluid path with coating material and then from said connection point into said reservoir; means, operative after operation of said flowing means, for cleaning coating material from at least a portion of said fluid path between the coating material supply and said connection point to electrically isolate the coating material supply from the coating apparatus and from said reservoir; and means, operative after said cleaning means cleans at least said portion of said fluid path, for delivering coating material in said reservoir through said fluid path from said connection point to the coating apparatus for being electrostatically charged and emitted by the coating apparatus.

2. A system as in claim 1, wherein the coating material supply is electrically grounded.

3. A system as in claim 1, including means for connecting the contents of said reservoir to ground potential whenever coating material in said reservoir is not being delivered to and electrostatically charged by the coating apparatus, and for disconnecting the contents of said reservoir from ground potential whenever coating material in said reservoir is being delivered to and electrostatically charged by the coating apparatus.

4. A system as in claim 1, including first measuring means for measuring the volume of coating material flowed from the coating material supply into said fluid path and said reservoir and for interrupting operation of said means for flowing when a preselected volume has been measured.

5. A system as in claim 4, including second measuring means for measuring the volume of coating material flowed through said fluid path from said connection point to the coating apparatus during operation of said delivering means, and for interrupting operation of said delivering means when a selected volume has been measured.

6. A system as in claim 5, wherein said selected volume of coating material is slightly less than said preselected volume, so that during a coating operation said delivery means delivers to the coating apparatus substantially all of the coating material in said reservoir.

7. A system as in claim 1, including means, operative after operation of said flowing means and prior to operation of said cleaning means, for introducing into an end of said fluid path at the coating material supply a volume of air sufficient to push coating material in said fluid path from the coating material supply to about said connection point and to thereby push an equivalent volume of coating material from said fluid path into said reservoir.

8. A system for delivering selected colors of electrically conductive coating materials from a color changer to high voltage electrostatic coating apparatus, said system comprising a fluid path for coupling an outlet from said color changer to the coating apparatus; a reservoir; means for coupling said reservoir to said fluid path at a connection point intermediate said color changer outlet and the coating apparatus; means for flowing a selected color of coating material from said color changer outlet first into and through said fluid path past said connection point to the coating apparatus and then from said connection point into said reservoir; means, operative after operation of said flowing means, for cleaning coating material from at least a portion of said fluid path between said color changer outlet and said connection point to electrically isolate said color changer from the coating apparatus and from said reservoir; means, operative after operation of said cleaning means, for delivering the selected color of coating material in said reservoir through said fluid path from said connection point to the coating apparatus for being electrostatically charged and emitted by the coating apparatus; and means, operative upon completion of delivery of the selected color of coating material in said reservoir to the coating apparatus, for cleaning said reservoir, said fluid path and the coating apparatus of the selected color of coating material in preparation for flowing the next selected color of coating material from said color changer outlet into said fluid path and then into said reservoir.

9. A system as in claim 8, wherein said means for cleaning said reservoir, said fluid path and the coating apparatus includes first means for cleaning said reservoir for a first period of time and second means for simultaneously cleaning said fluid path and the coating apparatus for a second and shorter period of time, such that cleaning of said fluid path is completed prior to completion of cleaning of said reservoir, and wherein said flowing means flows each successive selected color of coating material into and through said fluid path for flow past said connection point to the coating apparatus after completion of operation of said second cleaning means and while said first cleaning means continues to operate and then, after completion of operation of said first cleaning means, flows the next selected color of coating material from said connection point into said reservoir.

10. A system as in claim 9, wherein said color changer is grounded.

11. A system as in claim 9, including first measuring means for measuring the volume of coating material flowed from said color changer outlet into said fluid path and into said reservoir, and for interrupting operation of said means for flowing when a preselected volume has been measured.

12. A system as in claim 11, including second measuring means for measuring the volume of coating material flowed through said fluid path from said connection point to the coating apparatus during operation of said delivering means, and for interrupting operation of said delivering means when a selected volume has been measured.

13. A system as in claim 8, including means, operative after operation of said flowing means and prior to operation of said cleaning means, for introducing from said color changer outlet into said fluid path a volume of air sufficient to push coating material in said fluid path from said color changer outlet to about said connection point and to thereby push an equivalent volume of coating material from said fluid path into said reservoir.

14. A method of supplying electrically conductive coating material from a coating material supply to high voltage electrostatic coating apparatus, while maintaining electrical isolation between a high voltage at the coating apparatus and the coating material supply, said method comprising the steps of coupling the coating material supply to the coating apparatus through a fluid path; coupling a reservoir to the fluid path at a connection point intermediate the coating material supply and the coating apparatus; flowing coating material from the coating material supply first into and through the fluid path past the connection point to the coating apparatus to fill the fluid path with coating material, and then from the connection point into the reservoir; after completion of said flowing step, cleaning coating material from at least a portion of the fluid path between the coating material supply and the connection point to electrically isolate the coating material supply from the coating apparatus and from the reservoir; and, after performance of said cleaning step, delivering coating material in the reservoir through the fluid path from the connection point to the coating apparatus for being electrostatically charged and emitted by the coating apparatus.

15. A method as in claim 14, wherein the coating material supply is electrically grounded.

16. A method as in claim 14, including the steps of grounding the contents of the reservoir whenever coating material in the reservoir is not being delivered to and electrostatically charged by the coating apparatus, and ungrounding the contents of the reservoir whenever coating material in the reservoir in being delivered to and electrostatically charged by the coating apparatus.

17. A method as in claim 14, including the steps of measuring the volume of coating material flowed from the coating material supply into the fluid path and into the reservoir, and interrupting performance of said flowing step when a preselected volume has been measured.

18. A method as in claim 17, including the steps of measuring the volume of coating material flowed from the connection point to the coating apparatus during said delivering step, and interrupting performance of said delivering step when a selected volume has been measured.

19. A method as in claim 18, wherein the selected volume is slightly less than the preselected volume, so that said delivering step delivers substantially all of the coating material in the reservoir to the coating apparatus.

20. A method as in claim 14, including the step, performed after said flowing step and before said cleaning step, of introducing into an end of the fluid path at the coating material supply a volume of air sufficient to push coating material in the fluid path from the coating material supply to about the connection point and to thereby push an equivalent volume of coating material from the fluid path into the reservoir.

21. A method of supplying selected colors of electrically conductive coating materials from a color changer to high voltage electrostatic coating apparatus, while maintaining electrical isolation between a high voltage at the coating apparatus and the color changer, said method comprising the steps of coupling an outlet from the color changer to the coating apparatus through a fluid path; coupling a reservoir to the fluid path at a connection point intermediate the color changer and the coating apparatus; flowing a selected color of coating material from the color changer outlet first into and through the fluid path past the connection point to the coating apparatus, and then from the connection point into the reservoir; after completion of said flowing step, cleaning coating material from at least a portion of the fluid path between the color changer outlet and the connection point to electrically isolate the color changer from both the coating apparatus and the reservoir; after completion of said cleaning step, delivering the selected color of coating material in the reservoir through the fluid path from the connection point to the coating apparatus for being electrostatically charged and emitted by the coating apparatus; and, after completion of said delivering step, cleaning the reservoir, the fluid path and the coating apparatus in preparation for flowing the next selected color of coating material from the color changer outlet into the fluid path and into the reservoir.

22. A method as in claim 21, wherein said step of cleaning the reservoir, the fluid path and the coating apparatus includes the steps of cleaning the reservoir for a first period of time, and simultaneously cleaning the fluid path and the coating apparatus for a second and shorter period of time, such that cleaning of the fluid path and the coating apparatus is completed prior to completion of cleaning of the reservoir, and wherein said flowing step flows each successive selected color of coating material into and through the fluid path for flow past the connection point to the coating apparatus after completion of the step of cleaning the fluid path and the coating apparatus of the previously selected color of coating material and while said step of cleaning the reservoir of the previously selected color of coating material is still being performed, and then, upon completion of said reservoir cleaning step, flows the next selected color of coating material from the connection point into the reservoir.

23. A method as in claim 22, wherein the color changer is grounded.

24. A method as in claim 22, including the steps of measuring the volume of coating material flowed from the color changer outlet into the fluid path and into the reservoir, and interrupting performance of said flowing step when a predetermined volume has been measured.

25. A method as in claim 24, including the steps of measuring the volume of coating material flowed through the fluid path from the connection point to the coating apparatus during performance of said delivering step, and interrupting performance of said delivering step when a selected volume has been measured.

26. A method as in claim 21, including the step, after performance of said flowing step and prior to performance of said cleaning step, of introducing into the fluid path at the color changer outlet a volume of air sufficient to push coating material in the fluid path from the color changer outlet to about the connection point and to thereby push an equivalent volume of coating material from the fluid path into the reservoir.

* * * * *